US005215236A

United States Patent [19]

Waddell

[11] Patent Number: 5,215,236

[45] Date of Patent: Jun. 1, 1993

[54] CLIP-ON HAND CLASP FOR DISPOSABLE TAPE DISPENSERS

[76] Inventor: Troy R. Waddell, P.O. Box 51168, Amarillo, Tex. 79159

[21] Appl. No.: 849,617

[22] Filed: Mar. 10, 1992

[51] Int. Cl.[5] ..... A45C 11/00

[52] U.S. Cl. ..... 224/218; 224/267; 275/78

[58] Field of Search ..... 224/218, 219, 222, 217, 224/162, 267, 191, 268, 269; 225/42, 46, 66, 78; 242/55.2, 96; 206/411; 63/1.1, 3, 5.1, 6, 2, 15, 29.1; D11/3, 6, 1, 2, 4

[56] References Cited

U.S. PATENT DOCUMENTS

| | | | |
|---|---|---|---|
| D. 139,596 | 9/1944 | Preas | D11/4 |
| D. 261,123 | 10/1981 | Saffron et al. | D11/4 |
| 1,765,478 | 6/1930 | Baker et al. | 224/218 |
| 2,482,660 | 9/1949 | Dewey | D11/2 |
| 2,664,252 | 12/1953 | Glew | 242/55.5 |
| 3,273,766 | 9/1966 | Cosentino | 224/219 |
| 3,503,546 | 3/1970 | Hunt | 224/218 |
| 3,921,936 | 11/1975 | Suter | 242/55.5 |
| 3,980,245 | 9/1976 | Delehoy | 225/78 |
| 3,993,230 | 11/1976 | Oakes | 225/47 |
| 4,084,692 | 4/1978 | Bilweis | 206/403 |
| 4,606,484 | 8/1986 | Winter | 224/218 |
| 4,880,152 | 11/1989 | Trankle | 224/218 |
| 4,928,864 | 5/1990 | Walker et al. | 224/162 |

*Primary Examiner*—Henry J. Recla
*Assistant Examiner*—David J. Walczaki
*Attorney, Agent, or Firm*—Dowell & Dowell

[57] ABSTRACT

A clip-on clamp or bracket which is engageable over the back of an individual's hand which is used to selectively support a conventional disposable tape dispenser so that the dispenser does not interfere with the normal use of the individual's fingers and thumb.

6 Claims, 1 Drawing Sheet

CLIP-ON HAND CLASP FOR DISPOSABLE TAPE DISPENSERS

BACKGROUND OF THE INVENTION

1. Field of the Invention

This invention is generally directed to dispensers for supporting a rolled supply of adhesive tape or other material relative to an individual's hand and, more specifically, is directed to a C-shaped clamp or bracket which is engageable over the back of an individual's hand and to which a conventional disposable tape dispenser may be frictionally engaged to thereby support the dispenser on the back of an individual's hand so that the dispenser is readily available for dispensing tape without having to relocate the dispenser for each use and in such a manner that there is no interference with the normal dexterity of the individual's thumb or fingers.

2. History of the Related Art

In applicant's previous patent, U.S. Pat. No. 4,928,864, entitled HAND CLASP TAPE DISPENSER, a portable dispenser for dispensing a variety of tape materials is disclosed which incorporates a tape dispenser integrally formed with a C-shaped clamp which is engageable over the back of an individual's hand. Unlike previous hand supported dispensing devices, applicant's previous invention was directed to a dispenser which is easily mounted to the back of an individual's hand so as not to interfere with the normal use of the fingers and thumb. Further, the dispenser allowed for a supply of tape to be dispensed from the dispenser towards a cutting edge mounted in vertically spaced relationship with respect to the individual's thumb so that by a normal rolling action of the hand, tape could be dispensed and thereafter cut utilizing a normal hand motion. Such a dispenser provides a distinct advantage over prior tape dispensers in that the dispenser is always positively engaged with the individual's hand in such a position that the individual is not adversely affected by the positioning of the tape supply relative thereto. However, the dispenser was designed to allow replacement of rolls or spools of tape of a conventional size so that when one roll of tape had been exhausted, a replacement roll could easily be mounted to the dispenser.

Unfortunately, replacement rolls of tape are not always available in conventional retail stores and sometimes must be purchased from specialty office supply stores which are not readily available to the consumer. Therefore, consumers continue to utilize conventional disposable type adhesive tape and other dispensers which are purchased during routine shopping outings and such dispensers are conventionally sold in retail food and drug chain outlets. Such dispensers are not designed nor configured to be effectively retained or mounted to an individual's hand during their use. At some time, most individuals have experienced the frustration of wrapping numerous packages utilizing tape mounted to a disposable dispenser. During the packaging, the disposable tape dispenser is frequently misplaced and/or obscured thereby resulting in a great deal of inconvenience to the individual doing the wrapping.

Recently manufacturers of conventional adhesive tape have begun selling disposable dispensers which include cardboard backings which are mechanically secured to a plastic dispensing frame. Such dispensers are even bulkier than previous dispensers in that the cardboard backing is generally of a greater size than the plastic dispensing frame. Further, during dispensing, the cardboard frequently is deformed and pushed into an area where the cardboard interferes with the normal unreeling of a tape from the supply spool. Similar problems occur not only with adhesive tapes but with dispensers for ribbons, strings and other items which are wound on rolls or spools from which a selected length of material must be severed.

Prior to applicant's tape dispenser as described in U.S. Pat. No. 4,928,864, there were other dispensers which were designed to be engaged over a person's wrist or supported by the individual's fingers. In U.S. Pat. No. 3,993,230 to Oakes, an adhesive tape dispenser is disclosed having one or more openings through which a person's fingers may be extended to support the dispenser relative to the hand. Such a dispenser offers the ability to allow an individual to use both hands when dispensing the tape, however, as with applicant's prior invention, the dispenser is designed to accept only replacement spools of tape and is not designed to be utilized with conventional disposable tape dispensers which are mounted on disposable housings and not replaceable rolls or spools. Further, and as discussed in applicant's prior patent, the structure disclosed requires that the dispenser housing be supported by one or more fingers so that the physical dexterity of the individual is interfered with during tasks such as wrapping, holding, and supporting packages relative to the tape dispenser. Further, the patent to Oakes discloses different embodiments of dispensers which are designed alternatively for left or right hand use thereby requiring additional expenses in manufacturing to supply left or right hand dispensers.

In addition to the patent to Oakes, other prior art patents have dealt with providing carriers for attaching replaceable tape spools to an individual's wrist or forearm. In U.S. Pat. No. 3,921,936 to Suter, a masking tape dispenser is disclosed which includes a wristlet which is engageable over the forearm and from which a stud is mounted so as to support replaceable rolls of masking tape. Unfortunately, such a dispenser does not provide a cutting element and the dispenser is spaced at a distance from the individual's fingers so that it is difficult to urge only a small portion of the tape from the roll. Therefore, with such a device, frequently too much tape is dispensed leaving a free end portion of the tape dangling from the roll which portion mst be severed and disposed of before a new length of tape is dispensed. A similar type of dispenser is disclosed in U.S. Pat. No. 3,980,245 to Delehoy.

One prior art patent which has dealt with the problem of providing a mounting device for supporting conventional portable tape dispensers as opposed to tape supply rolls is disclosed in U.S. Pat. No. 4,880,152 to Trankle. This patent discloses a flexible support strap which is engageable about an individual's wrist and which is secured at its ends by conventional hook and loop fabric fasteners such as VELCRO. Mounted intermediate the length of the strap is a resilient and compressible cylinder which may be made of a material such as neoprene which is mounted on a shaft between flange elements which are compressed upon the rotation of a mechanical fastener, such as a conventional wing nut, so that as the wing nut is rotated, the neoprene core is caused to expand against the sidewalls defining the central opening which is conventionally found in most disposable tape dispensers and many non-disposable tape dispensers. In this manner, the patent does disclose a means for fastening portable tape dispensers relative to an individual's wrist. However, the device disclosed requires that the dispenser be mounted along the individual's forearm or wrist at a position wherein the supply of tape is remote from the individual's fingers. As with other types of spool type dispensers, such as those to Oakes and Suter, the tape must be extended well beyond the cutting mechanism associated with the housing to which the tape is mounted when being dispensed thereby leaving excess tape dangling from the dispenser after a segment of tape has been used. In addition, with the tape dispenser mounted on the individual's wrist or forearm, it is not possible to use normal hand dexterity to urge a section of tape from the supply roll with one hand and thereafter roll the other hand to create a severing of the tape as is possible and was discussed with respect to applicant's previous patent, U.S. Pat. No. 4,928,864. Band-like mounts of a configuration as disclosed in Trankle which are worn on an individual's wrist will also frequently rotate about the wrist during use unless an excess of force has been utilized to apply the band to the wrist which would not be comfortable to the individual.

Other dispensers which are designed to be supported by an individual's hand are disclosed in U.S. Pat. Nos. 2,664,252 to Glew, and 4,084,692 to Bilweis.

There have been numerous other devices designed for supporting different articles relative to an individual's hand. However, none of these devices provide a means for supporting conventional disposable tape dispensers and do not include structure which would permit such use. Such devices are disclosed in U.S. Pat. Nos. 181,755 to Webster, 1,139,942 to Wightman et al., 1,766,478 to Baker et al., 3,723,766 to Cosentino, 3,503,546 to Hunt, and 4,606,484 to Winter et al.

SUMMARY OF THE INVENTION

This invention is directed to a hand clasp or clamp for mounting disposable tape dispensers, and especially adhesive tape dispensers, to the back of an individual's hand and which include a generally C-shaped bracket which is of a configuration to extend over the back of an individual's hand having opposing end portions which are frictionally and resiliently engageable around the sides of the hand and between the thumb and forefinger so as to extend into the area of the palm and which include a resilient integrally formed retention element which extends from the upper surface of the clamp and from one side thereof. In the preferred embodiment, the retention element is opposed by a flange which extends along the opposing side of the gasket along the upper surface thereof in such a manner that the free edge of a conventional disposable tape assembly may be engaged beneath the retention element or clamp and against the flange to thereby physically and positively retain the dispenser in fixed relationship with respect to the hand clasp or clamp. In the preferred embodiment, the hand clamp or bracket is made of a slightly resilient or yieldable plastic material having spaced end portions, however, in some embodiments, the bracket may be made as a continuous band which surrounds the individual's hand so as to encircle the back and palm of the hand passing intermediate the thumb and forefinger.

It is the primary object of the present invention to provide a clamp or bracket which is engageable over an individual's hand and which does not interfere with the individual's fingers or thumb and to which conventional disposable tape dispensers may be selectively and positively mounted so that the tape from the disposable dispensers may be readily accessible for use in such a manner that maximum manual dexterity is permitted between one hand urging the tape from the dispenser and the other hand supporting the dispenser in such a position that the tape may be easily severed.

It is also an object of the present invention to provide a very low cost mounting bracket by way of which disposable tape dispensers, having plastic housings for supporting a single roll of tape, may be selectively mounted to an individual's hand so that the dispenser is readily and conveniently available for use.

DESCRIPTION OF THE PREFERRED EMBODIMENT

Figure 2:
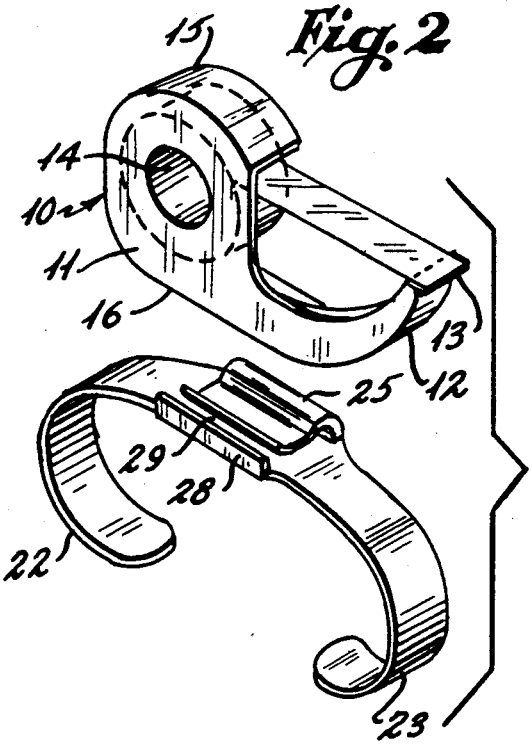
FIG. 2 is a perspective assembly view of the mounting bracket of FIG. 1 prior to the conventional disposable tape dispenser being mounted thereto.
Figure 3:
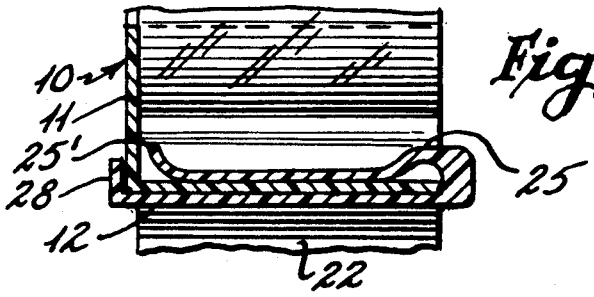
FIG. 3 is an enlarged partial cross-sectional view taken along lines 3—3 of FIG. 1.

With continued reference to the drawings, the present invention is designed to provide a support by way of which conventional disposable tape dispensers, and especially dispensers of the type for dispensing adhesive tape, may be retained in a fixed relationship with respect to an individual's hand during the use of such dispensers. In this respect, conventional disposable dispensers, especially of the adhesive tape type, include a plastic housing 10, a sidewall 11, a bottom wall 12 which extends outwardly and then upwardly to form a cutting edge 13, and a central hub 14 to which a roll of adhesive tape is mounted. Normally, in a disposable tape dispenser, the roll of adhesive tape is secured to the hub by a separate annular flange or flange elements which are deformed along the opposite side of the hub, so as to engage a portion of the periphery of the supply roll or reel. As shown in FIG. 2, the bottom wall 12 is also coextensive with an upper covering surface 15 which is not always present in all portable tape dispensers. Such portable tape dispensers are normally designed to either be sold with only a single sidewall 11 or are mounted on a paperboard or cardboard material which forms the opposite sidewall and which normally extends along the full length and width of the dispenser. Unfortunately, such paper and cardboard materials are easily bent and dislodged from the remaining plastic housing and therefore, at best, serve as means by which the dispensers may be advertised or displayed. In view of the foregoing, the sidewall 11 and bottom wall 12, along the lowermost portion 16 of the dispenser, form an L-shaped configuration, as is shown in FIG. 3.

Figure 5:
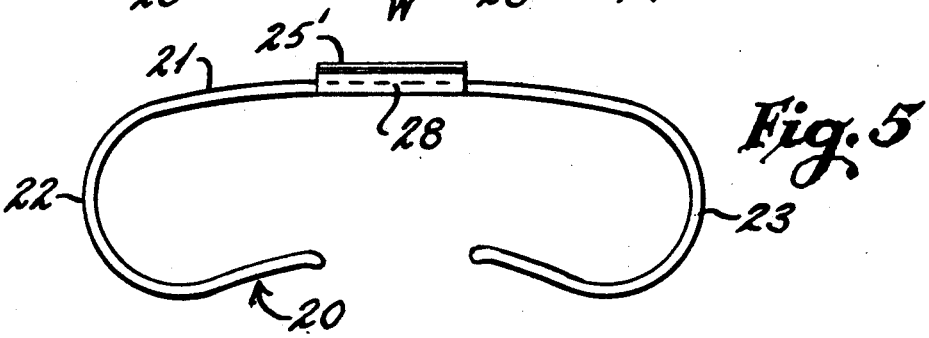
FIG. 5 is a front plan view of the hand clamp or bracket of FIG. 1 showing a second embodiment in dotted line.

In order to positively mount and retain disposable tape dispensers to an individual's hand, the present invention includes a hand clamp 20 which is shown in the preferred embodiment as being generally C-shaped having an upper portion 21 which is integrally formed with opposing side portions 22 and 23. In some instances, the clamp may be formed as a continuous band element as shown in dotted line in FIG. 5 of the drawings. It is preferred that the hand engaging clamp is of a size to extend over the back of an individual's hand H so that the opposing sides 22 and 23 thereof extend over one side of the hand and between the thumb and forefinger on the opposite side of the hand. In this manner, the clamp is designed to be worn over the back of the hand and engage at least a portion of the palm of the hand without interfering with the normal movement of the fingers and without interfering with the use of the thumb. Such a structure also permits the dispenser to be worn on either the individual's left or right hand and thus, separate bands or clamps are not required for left or right hand use.

The clamp or bracket member of the present invention also includes an integrally formed retention spring 25 which extends upwardly and across the upper and intermediate surface 21 thereof, with the base of the spring element extending from a first side 26 of the clamp. The outer edge of the spring element is flared upwardly and slightly outwardly, as shown at 25', so as to facilitate the resilient displacement thereof in order to permit an article, such as the bottom wall 12 of the dispenser, to be inserted thereunder.

As shown in FIG. 2, the spring element 25 is opposed in the preferred embodiment by an upstanding locking flange 28 which extends upwardly from the opposite side 27 of the hand clamp and thereby defines an elongated slot 29 between the flange and the spring element. When it is desired to mount a tape dispenser to the hand clamp, the bottom wall of the dispenser, which does not include a sidewall such as 11, is inserted within the slot 29 and thereafter the spring element urged upwardly to permit the bottom wall 12 of the dispenser to be introduced between the spring element and the upper surface of the clamp. As shown in FIG. 3, once the bottom wall is fully received within the spring element, the side wall 11 thereof will be seated against the locking flange 28, with the spring element 25 thereby frictionally and compressively securing the tape dispenser in fixed relationship with respect to the hand clamp.

Figure 1:
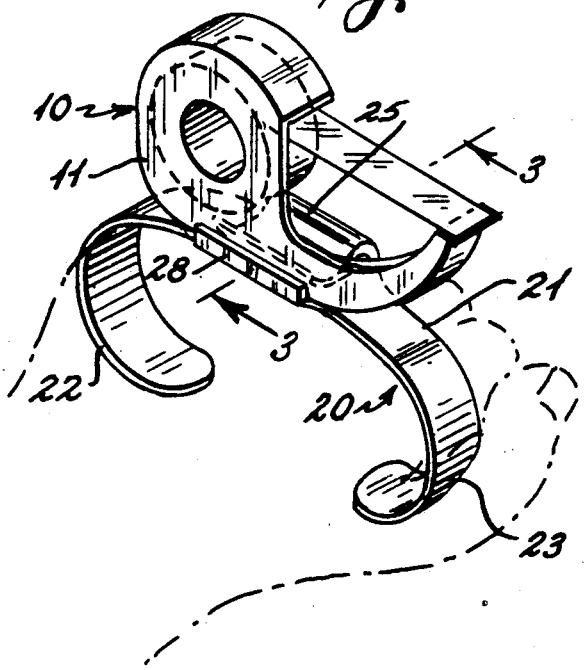
FIG. 1 is a perspective illustrational view of the hand clamp or bracket of the present invention having a conventional disposable adhesive tape dispenser selectively mounted thereto.
Figure 4:
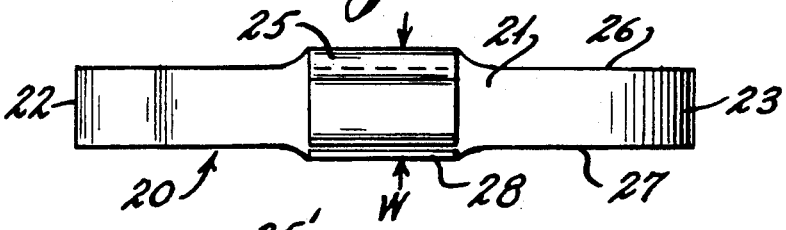
FIG. 4 is a top plan view of the hand clamp or bracket of FIG. 1.

As shown in FIG. 4, the hand clamp may be widened at the point of the spring element 25, as shown by W in the drawings, depending upon the size of dispenser that the hand clamp is designed to receive. Although the elongated opening 29 is shown as being oriented towards the individual's wrist in drawing FIGS. 1 and 2, the spring element 25 may be integrally formed with either sidewall 26 or 27 of the bracket element, with the opposing locking flange 28 being formed on the opposite sidewall.

The mounting hand clamp of the present invention is preferably formed of a plastic material which offers some resilience so that the opposing sides 22 and 23 of the clamp may be yieldable outwardly with respect to one another so that the clamp may be worn on hands of different sizes. In the embodiment shown in dotted line in FIG. 5, the dotted line portion of the band would offer some resilience towards the upper portion of the clamp 21 in order to effectively compress the continuous clamp against the backside and palm of an individual's hand.

In the use of the present invention it is understood that conventional supplies of tape and other materials such as ribbons mounted to dispensing spools carried by disposable housings of the type generally utilized with conventional adhesive-tape dispensers may be easily frictionally engaged by the spring element 25 associated with the hand clamp 20 and retained in engagement therewith by the locking flange 28. In some instances, it may be possible to dispense with the flange 28 by altering the configuration of the spring element to positively lock the spring with respect to the bottom wall 12 of the dispenser. Once a roll of tape has been dispensed from the disposable dispenser, the entire dispenser housing 10 is disposed of and a separate housing is inserted within the spring retention element of the hand clamp.

I claim:

1. A hand clasp for selectively supporting disposable tape dispensers of the type having a reel mounted to a sidewall and wherein a bottom wall extends from the sidewall and beneath the reel to an exposed edge, the hand clasp comprising, an intermediate portion having spaced opposing outermost portions, said intermediate portion being of a size to at least extend along the back and sides between a thumb and forefinger of an individual's hand and having first and second edges, a spring element extending upward from said first edge of intermediate portion and having a portion extending toward said second edge of said intermediate portion and being resiliently yieldable with respect to said intermediate portion whereby said bottom wall of said dispenser may be selectively inserted between said spring element and said intermediate portion to selectively retain the dispenser with respect to said hand clasp.

2. The hand clasp of claim 1 including a locking flange formed along said second edge of said intermediate portion and in spaced relationship with respect to said spring element, and a slot being defined between said locking flange and said spring element through which the bottom wall of the dispenser may be selectively inserted.

3. The hand clasp of claim 2 in which said spring element includes an outermost edge portion, said outermost edge portion being oriented upwardly and outwardly with respect to said intermediate portion of said hand clamp.

4. The hand clasp of claim 3 in which said clasp is integrally formed of a resilient plastic material.

5. The hand clasp of claim 3 in which said intermediate portion and outermost portions are formed as a continuous band.

6. The hand clasp of claim 5 in which said band is formed of a resilient plastic material.

* * * * *